United States Patent [19]

Sano

[11] Patent Number: 4,664,047

[45] Date of Patent: May 12, 1987

[54] METHOD OF FORMING STITCHED PATTERNS IN COMBINATION IN A SEWING MACHINE

[75] Inventor: Yasuro Sano, Tokyo, Japan

[73] Assignee: Janome Sewing Machine Co., Ltd., Tokyo, Japan

[21] Appl. No.: 799,441

[22] Filed: Nov. 19, 1985

[30] Foreign Application Priority Data

Nov. 20, 1984 [JP] Japan ..... 59-243256

[51] Int. Cl.[4] ..... D05B 3/02

[52] U.S. Cl. ..... 112/266.1; 112/454; 112/456; 112/458

[58] Field of Search ..... 112/456, 454, 457, 458, 112/453, 266.1, 262.1, 121.11, 121.12

[56] References Cited

U.S. PATENT DOCUMENTS 4,499,838 2/1985 Voza ..... 112/456 X 4,522,137 6/1985 Takenoya et al. ..... 112/266.1

4,572,095 2/1986 Makabe et al. ..... 112/456

*Primary Examiner*—Peter Nerbun

*Attorney, Agent, or Firm*—Michael J. Striker

[57] ABSTRACT

If a predetermined pattern to be stitched exceeds a maximum amplitude amount available in a sewing machine, such a pattern is divided into appropriate shapes, and the divided shapes are stored in an electronic memory as pattern forming elements to be sized within the maximum amplitude amount. The pattern forming elements are classified into a first pattern group which is symmetrical with respect to a central basic line, a second pattern group which is formed at a left or right side of the central basic line, and a third pattern group which is asymmetrical with respect to the central basic line. The pattern forming elements are used in common to some of other predetermined patterns, and when those are selectively combined, the predetermined pattern may be produced into a stitched pattern.

3 Claims, 4 Drawing Figures

FIG_3
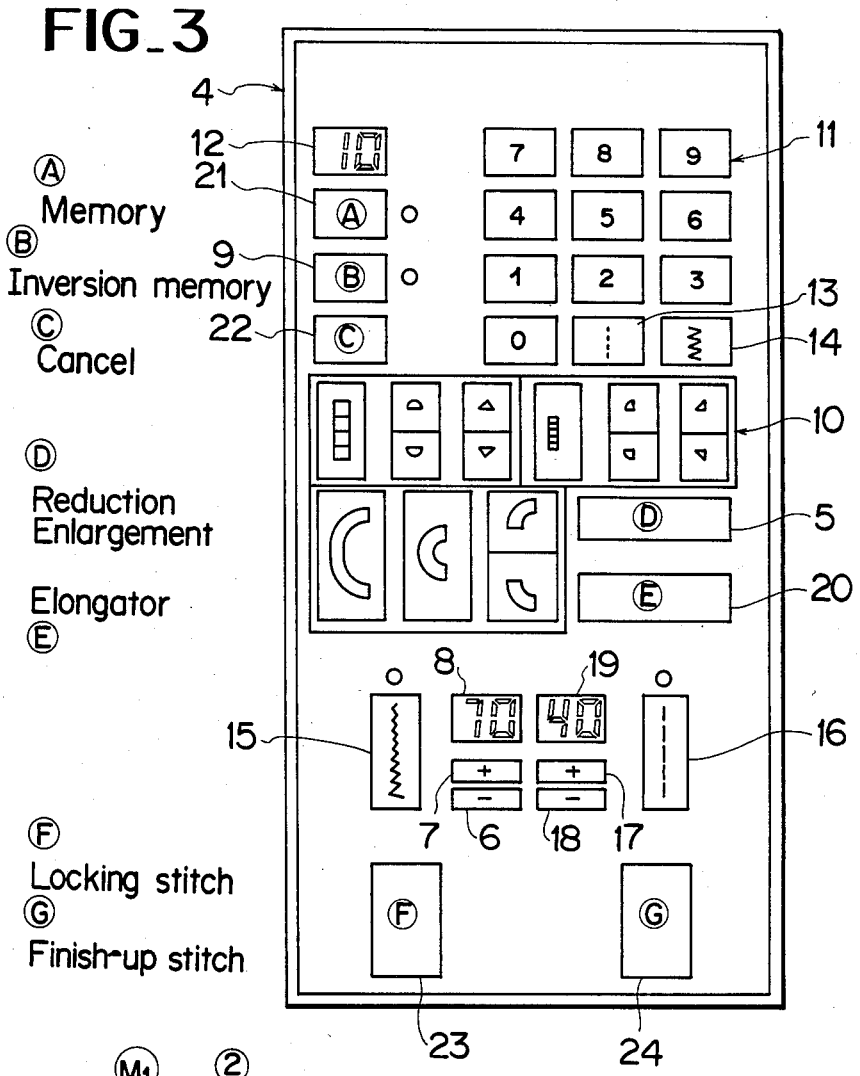
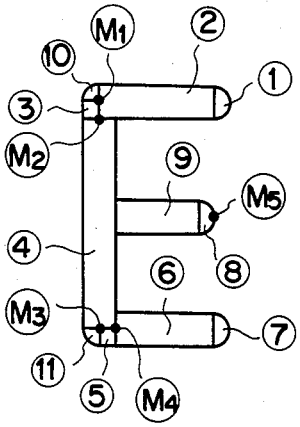
FIG_4

METHOD OF FORMING STITCHED PATTERNS IN COMBINATION IN A SEWING MACHINE

BACKGROUND OF THE INVENTION

Field of the Invention

The present invention relates in general to a sewing machine which stores stitching control signals in an electronic memory, and forms stitched patterns thereby and more particularly to stitched patterns.

Recently, computerization of sewing machines has been progressed, and patterns as letters, numerals or abstract patterns have been easily stitched.

However, patterns to be formed by a straight stitching sewing machine are limited to about 10 mm in an amplitude amount, and if a pattern exceeds 10 mm, embroidering frames should be subjected to X-Y control.

SUMMARY OF THE INVENTION

It is an object of the present invention to provide improved pattern forming elements of the sewing machine.

If the patterns predetermined to be stitched exceed the maximum amplitude amount of a sewing machine, such patterns are, according to the invention, divided into patterns of appropriate shapes, and the divided patterns are stored in an electronic memory of the sewing machine as pattern forming elements to be sized within the maximum amplitude amount. Said shapes are also used in common to some of the predetermined patterns, and if those are selectively combined, said predetermined pattern exceeding the maximum amplitude may be produced into a stitched pattern.

The pattern forming elements are classified in the following groups:

A 1st pattern group is symmetrical with respect to a central basic line, where the pattern is adjusted in a distance between said central basic line and respective ends thereof at a ratio designated by a proportion control means.

A 2nd pattern group is formed at a left or right side of the central basic line, with its one end being held to the central basic line, and the distance between the central basic line and the other end thereof is controlled at a ratio designated by means of the proportion control means.

A 3rd pattern group is asymmetrical with respect to the central basic line, with one end thereof being held to the left or right basic line and the distance between said either basic line and the other end thereof is controlled at a ratio designated by means of the proportion control means.

Thus, a combined pattern is formed in size in response to a value controlled in common by the proportion control means.

BRIEF DESCRIPTION OF THE DRAWINGS

FIG. 3 shows a panel for operating the sewing machine; and

FIG. 4 illustrates a sequential operation for forming a combined pattern in accordance with the invention.

DETAILED DESCRIPTION OF PREFERRED EMBODIMENT

An explanation will be made to an embodiment of the invention with reference to the attaching drawings.

Figure 1:
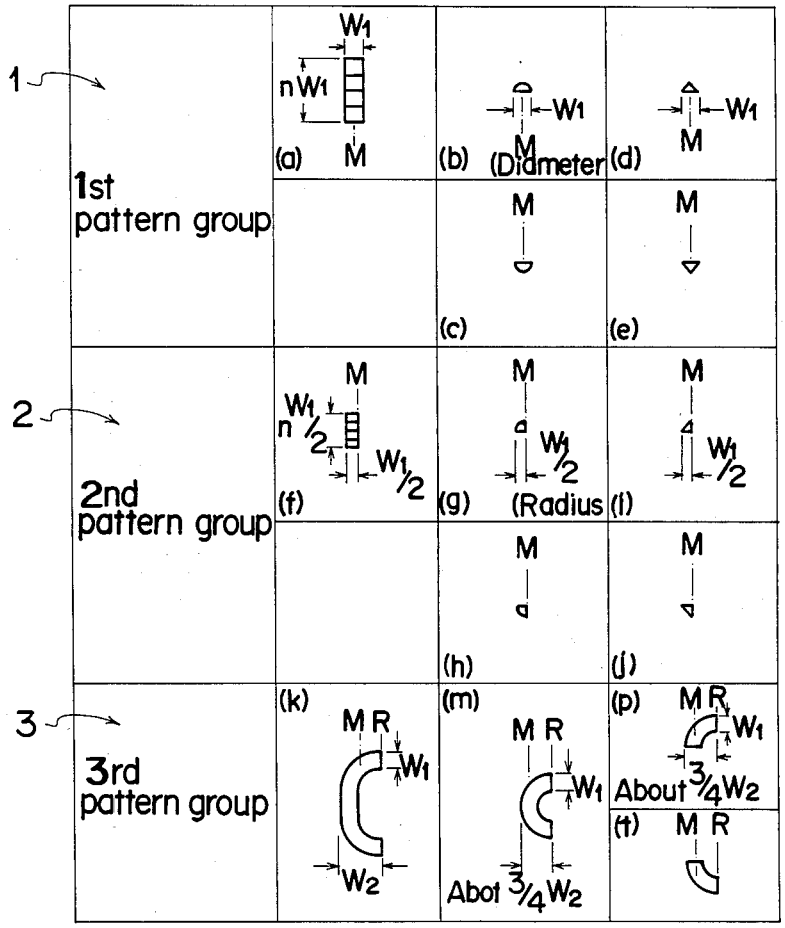
FIG. 1 shows various shapes of pattern forming elements illustrating an embodiment of the invention.

FIG. 1 shows the pattern forming elements by stitching control signals stored in the electronic memory of the sewing machine. Each of the pattern elements is sized within 10 mm in amplitudes (W1, W2) in a lateral direction, which is the maximum amplitude available in the sewing machine, and is constituted by dividing Roman characters or numerals into the appropriate shapes. The divided pattern forming elements are combined in the minimum feed by a basic zigzag stitching to form the patterns such as Roman characters or numerals exceeding 10 mm.

The pattern element is composed of the 1st pattern group 1, the 2nd pattern group 2 and the 3rd pattern group 3, and the amplitude amounts W1, W2 and lengths in the feed directions are set as the automatically setting values. Adjustments of their sizes are designated by operating in conjunction a reduction-enlargement key 5, an amplitude enlargement key 6, and an amplitude reduction key 7 positioned on the panel of the sewing machine, shown in FIG. 4. On luminous indication of the designating value in an amplitude indicator 8, the length in the feed direction and the amplitude amounts W1, W2 are reduced or enlarged at a ratio in common in response to said designation, while the pitch of the minimum feed is maintained as it is.

The 1st pattern group 1 is formed symmetrically with respect to the central basic line (M), and the stitching start and finish are positioned on the central basic line. The amplitude amount W1 by the automatic setting is determined about $\frac{1}{3}$ of the amplitude amount W2 set within 10 mm being the maximum amplitude amount available of the sewing machine, and the amplitude around W1 is enlarged or reduced amount the central basic line (M) by the keys 5,6,7 of FIG. 3.

Figure 2:
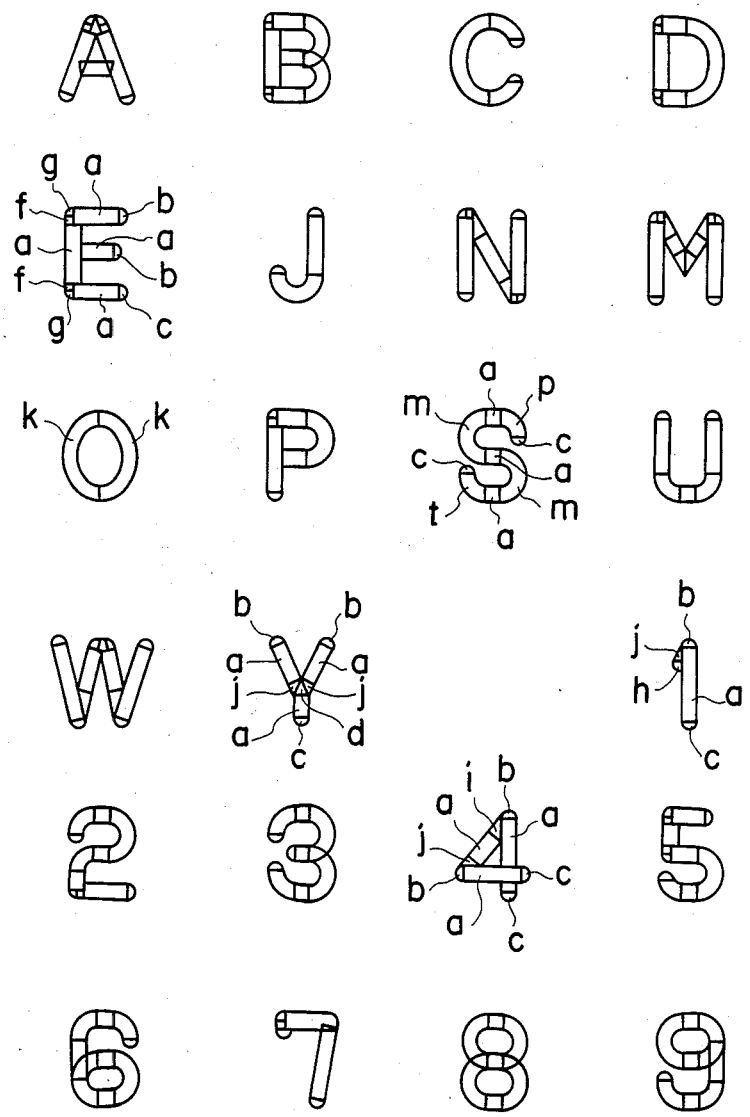
FIG. 2 shows examples of patterns combined with the pattern forming elements of FIG. 1.

A pattern (a) of FIG. 1 is used in a part shown by a mark (a) of, e.g., a letter "E" of FIG. 2, and with respect to the length in the feed direction each block of regular square is 1 memory unit. If the block is memorized n times by a memory key 21, a designation is made to automatically stop the sewing machine each time of forming n squares, and the length in the feed direction is set appropriately by the operations of n times.

Patterns (b),(c) of FIG. 1 are similarly used in parts shown by marks (b),(c) of FIG. 2, and when the patterns of unit are finished, the sewing machine is automatically stopped. Patterns (d),(e) are yet used in a part shown by the mark (d) in the letter "Y" or in substitution for the patterns (b),(c).

The 2nd pattern group 2 is formed at the left side of the central basic line (M), and its end stands on the central basic line (M), and the stitching start and finish are positioned on the central basic line (M). If an inversion memory key 9 of the panel of FIG. 3 is operated, the left and the right are inverted around the central basic line (M). The amplitude amount of the automatic setting is determined $W \cdot \frac{1}{2}$, and the amplitude amount $W \cdot \frac{1}{2}$ is increased or reduced by operation of the keys 5,6,7.

A pattern (f) is used in parts shown by a mark (f) in the letter "E" of FIG. 2, and with respect to the length in the feed direction, the same length as that of the pattern (a) is applied to the sewing machine. A pattern (g) is similarly used in parts shown by a mark (g). Patterns (i),(j) are used in parts shown by marks (i),(j) in the pattern numeral "1" and "4" of FIG. 2 in the basic size or the twice enlarged size.

The 3rd pattern group 3 is formed at the left side of a right basic line (R), and its end is positioned at the right basic line (R), while the stitching start and finish are positioned at the right basic line (R). If the inversion memory key 9 is operated, the left and the right are inverted around the central basic line (M). The amplitude amount W2 of the automatic setting is determined within 10 mm of the maximum amplitude of the sewing machine, and the amplitude amounts W1, W2 are increased or decreased within a reduced range by the keys 5,6,7. An amplitude amount of the pattern (k) is set at said amplitude amount W2 and is used to form parts shown by marks (k) of a letter "O" of FIG. 2. Patterns (m),(p),(t) are determined about ($\frac{3}{4}$)W2 in the amplitude amount, and are used to parts shown by marks (m), (p),(t).

In FIG. 3, each of pattern element designating keys 10 is provided to individually designate each of the pattern elements. Ten keys 11 are for designating ordinary patterns with pattern numbers of two figures, and a pattern number indicator 12 indicates it. In general, the straight stitching and the basic zigzag stitching are frequently used, and they are directly selected by keys 13,14. An amplitude adjusting key 15 is used together with an amplitude enlargement key 6 and an amplitude reduction key 7 for designating an adjustment of the amplitude amount, and a designated result is shown in the amplitude indicator 8. A feed adjustment 16 is used together with a feed enlargement key 17 and a feed reduction key 18 for designating an adjustment of the feed amount, and a designated result is shown in the feed indicator 19.

If an elongator key 20 is operated after the pattern element designating key 10 has been operated, it is used together with the feed enlargement key 17 and the feed reduction key 18 for designating enlargement or reduction of the length in the feed direction by increasing or reducing stitches, while on the other hand a pitch of unit of the minimum feed is maintained as it is. A memory key 21 is selected by the pattern element designating key 10 and the ten-keys 11, and is operated for successively storing the adjusted and designated patterns in the sewing machine, and is used for designating the length in the feed direction with respect to the pattern (a). A cancel key 22 is operated for cancelling the key operations. A lock stitching key 23 is operated for designating lock stitching, and a finish-up stitching key 24 is operated for designating finish-up stitching.

An explanation will be now made to a means for forming a pattern of a letter "E" with reference to FIG. 4.

At first, for forming parts 1, 2 shown in FIG. 4, the pattern element designating key 10 and the memory key 21 are operated to store the pattern element (b) of FIG. 1 and successively the pattern element (a). In this case, the memory number n in FIG. 1 is 3, and when the stitching of said elements is finished, the needle is stopped at the lower dead point on the central basic line M1. For forming a part 3, the fabric is turned by 90° clockwise to designate th pattern element (f), and when the stitching is started under the condition that the memory number n is 1, the needle is stopped at the lower dead point on the central basic line M2. For forming a part 4, the pattern element (a) is designated, and when the stitching is carried out under the condition that the memory number n is 6, the needle is stopped at the lower dead point on the central basic line M3. For forming a part 5, the fabric is turned by 90° clockwise, and when the stitching is formed by the pattern element (f) in the same way as the part 3, the needle is stopped at the lower dead point on the central basic line M4. A part 6 is formed in the same way as the part 2. A subsequent part 7 is formed by a designation of the pattern element (c). In succession, the fabric is turned 180° for forming parts 8, 9 so as to exactly determine the positioning for the fabric at the central basic line M5 and the parts 8, 9 are formed by the pattern elements (b), (a) as the parts 1, 2. Finally, parts 10, 11 are formed with the pattern element (h) and an inverted pattern element thereof by positioning the central basic lines M1, M3 with respect to the fabric.

According to the invention, patterns such as letters, numerals and others exceeding the maximum amplitude amount available in the sewing machine, may be formed by means of lesser numbers of pattern elements, and sizes of patterns to be formed may be easily controlled.

What is claimed is:

1. A method for forming stitch patterns of zigzag or satin stitches by means of a sewing machine having an electronic memory for storing various patterns in the form of data for controlling a needle position within a predetermined maximum needle swinging range having reference basic needle positions at the right and left ends and at the center thereof and for controlling a fabric feeding amount and a direction within a predetermined maximum feeding range, and proportion control means for reducing or enlarging each of the stitches of a selected pattern at a common proportion within the predetermined maximum needle swinging range, said method comprising the steps of dividing a predetermined pattern which exceeds the maximum needle swinging range into a plurality of patterns of appropriate shapes; storing divided patterns obtained in said dividing step in said electronic memory as pattern forming elements for forming each of the stitches constituting said predetermined patterns; and classifying said divided patterns into at least three types, a first type including patterns of zigzag or satin stitches which are formed in symmetry in reference to the center basic needle position of the maximum needle swinging range and may be reduced or enlarged at a common proportion within the maximum needle swinging range, a second type including patterns of zigzag or satin stitches which are formed at one side of the center basic needle position in reference thereof and may be reduced or enlarged at a common proportion within a half of the maximum needle swinging range, and a third type including patterns of zigzag or satin stitches which are formed in reference to one of the extreme right and left basic needle positions toward the opposite extreme basic needle position and may be reduced or enlarged at a common proportion within the maximum needle swinging range.

2. The method as defined in claim 1, wherein said predetermined pattern and said divided patterns constitute all in combination a monogram pattern of a size beyond said predetermined maximum needle swinging range.

3. The method as defined in claim 2, wherein said predetermined pattern is a number pattern and said divided patterns constitute all in combination said number pattern of a size beyond said predetermined maximum needle swinging range.

* * * * *